US007908731B2

(12) United States Patent
Binggeli

(10) Patent No.: US 7,908,731 B2
(45) Date of Patent: Mar. 22, 2011

(54) FOLDED-SEAM CONNECTION, METHOD OF PRODUCING IT AND DEVICE

(75) Inventor: Rudolf Binggeli, Wohlen (CH)

(73) Assignee: Spiro S.A., Fribourg (CH)

( * ) Notice: Subject to any disclaimer, the term of this patent is extended or adjusted under 35 U.S.C. 154(b) by 0 days.

(21) Appl. No.: 12/550,748

(22) Filed: Aug. 31, 2009

(65) Prior Publication Data

US 2009/0320954 A1 Dec. 31, 2009

Related U.S. Application Data

(62) Division of application No. 11/546,140, filed on Oct. 11, 2006, now abandoned, which is a division of application No. 10/450,500, filed on Feb. 5, 2004, now Pat. No. 7,121,129.

(51) Int. Cl.

| | |
|---|---|
| ***B23P 11/00*** | (2006.01) |
| ***B21D 15/00*** | (2006.01) |
| ***B21D 39/02*** | (2006.01) |
| *F16L 19/04* | (2006.01) |

(52) U.S. Cl. ..... 29/509; 29/437; 29/890.149; 29/243.5; 29/511; 72/107; 72/110; 285/181; 285/382; 138/155; 138/168

(58) Field of Classification Search ..... 29/509, 29/511, 243.5, 243.58, 890.149, 437; 72/107, 72/110; 285/148.24, 272, 382, 903, 179.2, 285/181, 183, 184, 424; 138/109, 152, 155, 138/168

See application file for complete search history.

(56) References Cited

U.S. PATENT DOCUMENTS

| | | | |
|---|---|---|---|
| 275,205 | A | 4/1883 | Harris |
| 319,144 | A | 6/1885 | Stephens et al. |
| 451,550 | A | 5/1891 | Bayer |
| 868,524 | A | 10/1907 | Bayer |
| 1,259,233 | A | 3/1918 | Hartman |
| 1,522,630 | A | 1/1925 | Ireland |
| 1,791,255 | A | 2/1931 | Wagner |
| 1,796,015 | A | 3/1931 | Francis et al. |
| 1,970,650 | A | 8/1934 | Fulton |

(Continued)

FOREIGN PATENT DOCUMENTS

WO 00/27557 5/2000

OTHER PUBLICATIONS

Definition of EUROVENT Class C: European Standard DIN EN 12237, "Strength and leakage of circular sheet metal ducts", European Committee for Standardization, Brussels, Jul. 2003. See p. 6, 4 Classification, "Air tightness class" C, (3rd line).

(Continued)

*Primary Examiner* — Essama Omgba
(74) *Attorney, Agent, or Firm* — Ladas & Parry LLP

(57) ABSTRACT

In ventilation and air-conditioning technology, so-called spiral pipes have to be joined together in a tightly sealed manner at widely differing angles, which is generally carried out by segment bends and pipe sections. An improved, durable seal of folded-seam connections is achieved by a flange-like double fold which is arranged at a first pipe end and which is surrounded on the outside at least in part with positive locking and with a continuous metal seal, by a second double fold at the second pipe end.

4 Claims, 6 Drawing Sheets

U.S. PATENT DOCUMENTS

| | | | | |
|---|---|---|---|---|
| 2,039,886 | A | 5/1936 | Cohn | |
| 2,150,361 | A | 3/1939 | Chobert et al. | |
| 2,522,195 | A | 9/1950 | Richardson | |
| 2,531,349 | A | 11/1950 | Brett | |
| 2,703,110 | A | 3/1955 | Curtis | |
| 2,756,778 | A | 7/1956 | Curtis | |
| 2,878,838 | A | 3/1959 | Budge | |
| 2,880,017 | A | 3/1959 | Anderson | |
| 2,965,397 | A | 12/1960 | Vanden Berg | |
| 3,603,057 | A | 9/1971 | Curran | |
| 3,724,255 | A | 4/1973 | Molino | |
| 3,805,845 | A | 4/1974 | Santoro | |
| 3,815,394 | A | 6/1974 | Walker | |
| 3,848,308 | A | 11/1974 | Kaval | |
| 4,538,334 | A | 9/1985 | Binggeli | |
| 4,865,365 | A | 9/1989 | Meinig | |
| 5,875,670 | A | 3/1999 | Stojkovski et al. | |
| 5,934,710 | A | 8/1999 | Le Foll | |
| 6,311,379 | B1 | 11/2001 | Torre et al. | |
| 6,557,901 | B1 | 5/2003 | Garat | |
| 6,598,285 | B1 | 7/2003 | Binggeli et al. | |
| 6,739,348 | B2 * | 5/2004 | Inch et al. | 134/186 |
| 7,066,495 | B2 * | 6/2006 | Thomas et al. | 285/226 |
| 7,121,129 | B2 * | 10/2006 | Binggeli | 72/110 |
| 7,162,788 | B2 * | 1/2007 | Inch et al. | 29/458 |
| 7,708,034 | B2 * | 5/2010 | Gudenburr et al. | 138/156 |

OTHER PUBLICATIONS

"Gorelocker Beta 3" brochure 05.1998 (in German), of Spiro International S.A. 1998 (4 sheets).

"Gorelocker Beta 3" brochure 04.2001 (in English) of Spiro International S.A., 2001 (4 sheets).

* cited by examiner

Fig. 2
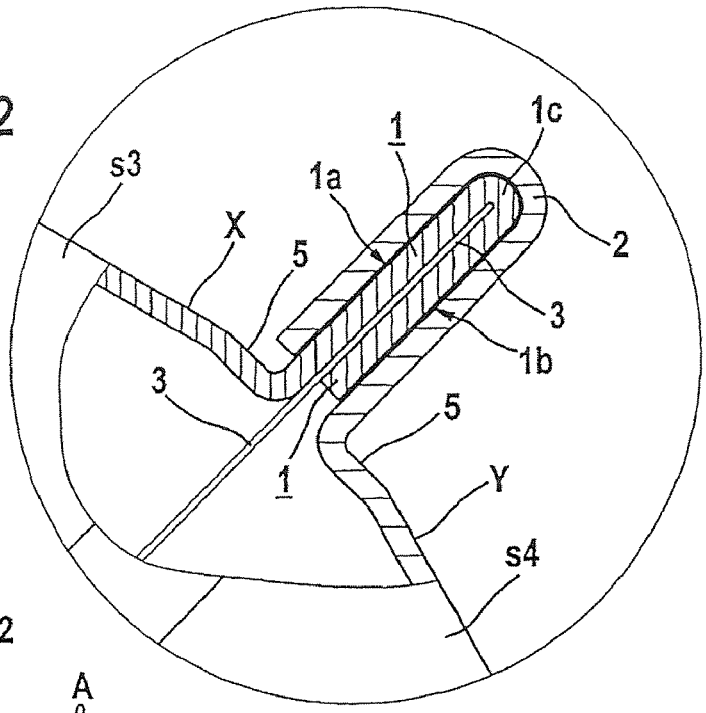
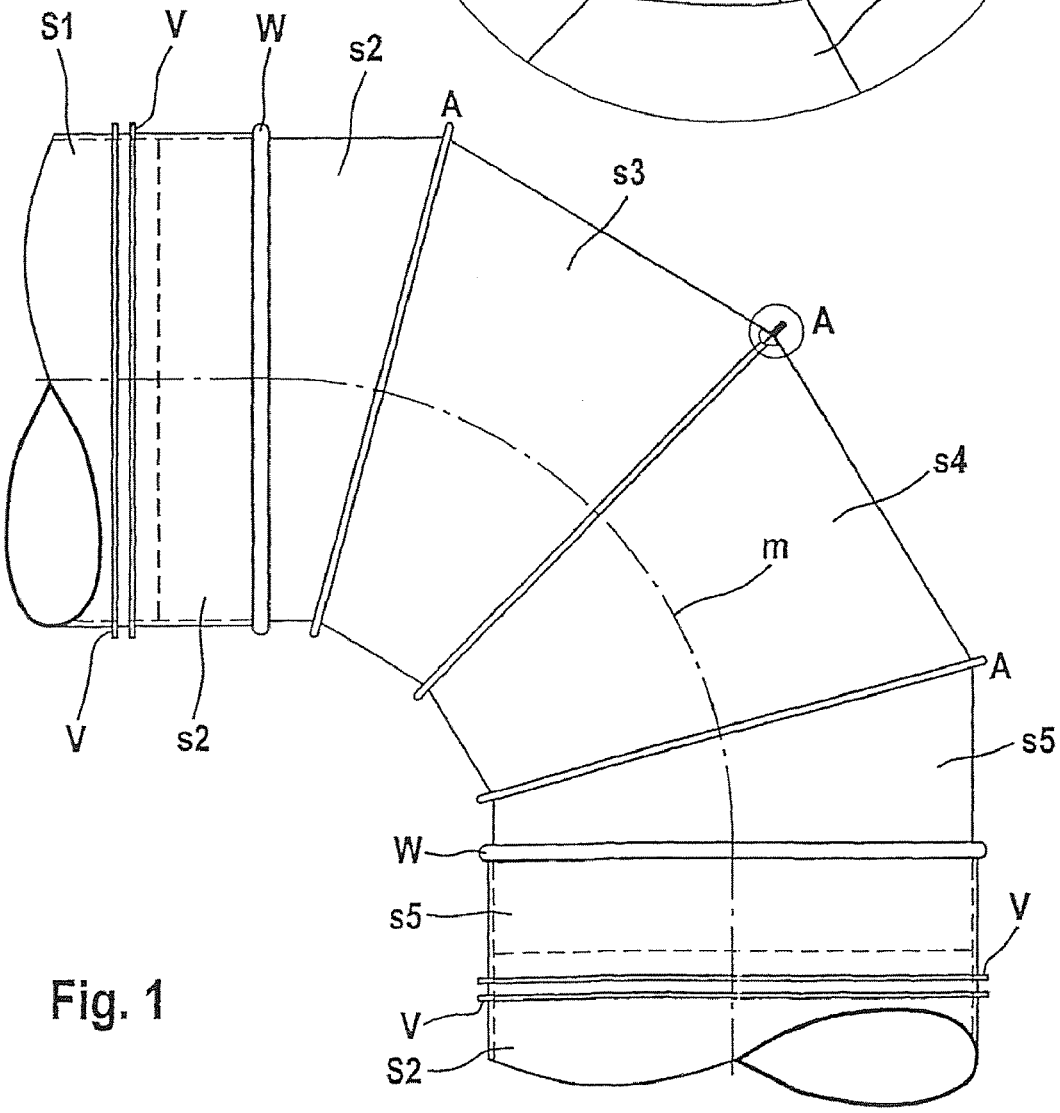
Fig. 1

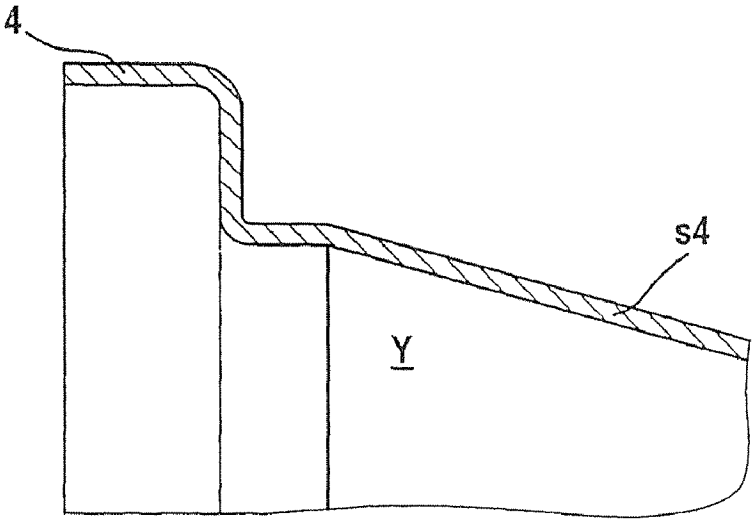
Fig. 7
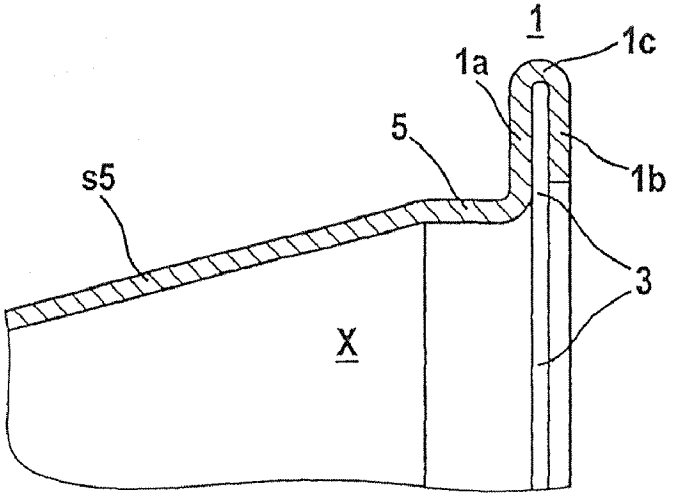
Fig. 8
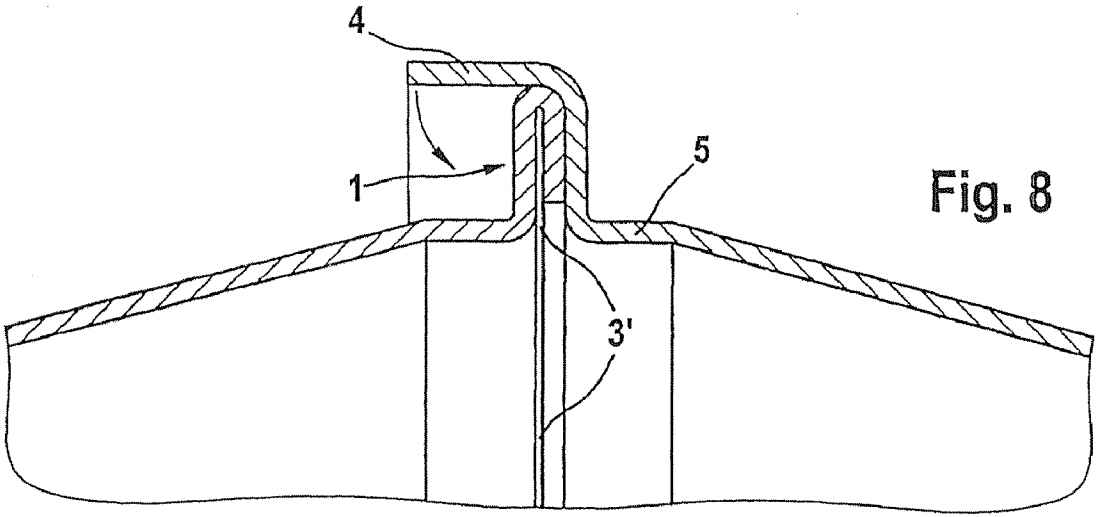

FOLDED-SEAM CONNECTION, METHOD OF PRODUCING IT AND DEVICE

The present application is a Divisional of U.S. application Ser. No. 11/546,140, filed Oct. 11, 2006, now abandoned which is itself a Divisional of application Ser. No. 10/450,500, filed Feb. 5, 2004 now U.S. Pat. No. 7,121,129.

BACKGROUND OF THE INVENTION

The present invention relates to a folded-seam connection and to a method of producing it, as well as to a device for performing the method.

Folded-seam connections are well known in ventilation and air-conditioning technology. These connections have the inherent drawback that they are not tight, since after it has been produced any folded-seam connection will tend to spring back, i.e. to open. The resulting leakage losses of connections of this type, however, are frequently unacceptable on the grounds of hygiene, health and/or energy, so additional action is necessary for sealing, for example for inserting a strip of rubber and/or for securing the folded-seam connection by adhesion; cf. inter alia WO 00/27557, FIGS. 10 to 13, in which various ways in which to clamp seals are illustrated.

This leads to further drawbacks: As well as the resulting high outlay in materials and time for introducing additional sealing material into the folded-seam connection its effectiveness is substantially dependent upon the carefulness of the user (worker). In addition, even synthetic sealing materials tend to become brittle and withstand only slight differences in pressure, in particular if relatively large gaps and/or shearing forces are involved.

BRIEF SUMMARY OF THE INVENTION

The object of the present invention is to provide a metallic sealing folded-seam connection which can adequately meet the high sealing demands in practice today. In particular, the folded-seam connection should also be suitable for ventilation units of Sealing Class C, without additional sealing means and/or subsequent processing being required. This Class C, applied to folded-seam connections of high sealing tightness, has been defined by the Committee of Producers of "Ventilation and Drying Plants (EUROVENT)" and corresponds to a maximum leakage of for example 0.01 $m^3$ of air per s, with a test area of 200 $m^2$ under a test pressure of 1000 Pa.

A method should likewise be disclosed which will allow folded-seam connections of this type to be produced economically. In addition, a suitable device should be provided which will ensure the quality of the folded-seam connection in an economic manner and which can be applied as universally as possible, i. e. is suitable for pipes, pipe segments and pipe bends.

It should be possible to produce with conventional technology the folded-seam connection to be provided, which should not require any special training on the part of the processing personnel and which should at least correspond in its appearance and stability to the customary one.

The folded-seam connection produces in the interior of the fold a form fitting seal, in particular on the external diameter of the flange-like double fold as a result of the relatively large bending radius of the surrounding second outer double fold. As a result, the springing back of the connection is minimized; the metallic seal is durable and susceptible to vibration to only a negligible degree. The radius of embracing in the region of the greatest external diameter on the external double fold is greater than an enclosed flange turned over in a single manner (also called a single edge). This prevents overextension of the bending point, which is impermissible in terms of materials, and thus massive material displacement, hairline cracks and subsequent corrosion on the fold, as frequently observed on existing ventilation units.

The term "all around continuous" accordingly means that a form fitting sealing face is provided which rests against the matching member and which extends in a linear and coaxial manner and without interruptions over the entire periphery of the folds.

If a folded-seam connection according to the invention is cut open, in contrast to a connection with a flange turned over in a single manner it displays an almost ideal metallic sealing contact face which embraces the entire inner double flange in a precise manner with respect to its shape.

What is crucial for the proper sealing behavior of the connection is the above-mentioned all around continuous design of the sealing faces, since, in addition to the actual closure, these form one or more high-quality labyrinth seals with minimal leakage losses.

In contrast, it has been found to be advantageous if the flange-like double fold has an air gap situated on the inside, so that there is a deliberate springing action of the inner fold against the interior of the second double fold. This ensures a durable metallic seal even when operating with varying pressure ratios.

In particular, in the case of non-plated pipes an insulating layer of a polymer applied in the liquid state may be advantageous, since no contact corrosion occurs at the connection point in the fold; the thin layer remaining after gardening will then additionally take on a compensating and sealing function. Functionally an insulating layer does not alter the basic principle of positive locking effective during the closing procedure and produced by external forces, even if the metallic contact faces are supplemented by thin intermediate layers or if a metallic plating of the metal sheet is replaced and/or supplemented by an insulating layer.

An air gap subjected to a powerful external clamping action between the flange parts, which results in the strong springing action thereof, is particularly advantageous. This improves the sealing as a result of the high pressing between the contact faces on the one hand and can compensate thermal expansion and vibration, without increased leakage, on the other hand.

The sealing behavior can be additionally improved by the inclusion of an additional insulating layer between the outer and the inner fold.

The folded-seam connection can be produced on a bordering and folding/closing machine of the type GORELOCKER BETA 3 of the firm Spiro International S.A., CH-3178 Boesingen (cf. Brochure 05, 1998), by means of suitable rollers.

This takes place in that in a first method step a flange-like double fold is produced at a first pipe end, in a second method step a folding tab with an internal diameter larger than the flange-like double fold is formed on the other pipe end to be joined, in a third method step the folding tab is pushed over the double fold and after that the projecting part of the folding tab is pressed and clamped against the flange-like double fold in an abutting manner, so that the latter is surrounded in a sealed manner.

In a device according to the invention which is preferably used, the production of the flange-like double fold at the first pipe end takes place in that in a first method step the first pipe end is put onto a rotating first shaping roller fixed in the axial position on the machine bench, with peripheral contact on the inside of the pipe and said roller, in a second step a second shaping roller likewise rotating is pushed in the tangential plane thereof until it touches the pipe end on the outside so that the latter jointly rotates in synchronism, in a third step the second shaping roller is pushed stepwise in the tangential plane by the width of the double fold against the first shaping roller so that a continuous folding tab is impressed at the pipe end, in a fourth step a lower delivery roller is pushed further in the direction towards the shaping roller in a second plane situated at a lower level than the tangential plane by at least twice the thickness of the pipe material, wherein a lower roller is drawn back under the second shaping roller in synchronism in the opposite direction, so that the folding tab is closed and a flange-like double fold is formed.

A device which is particularly suitable for producing a flange-like double fold is characterized in that a displaceable lower roller is constructed in the form of a hollow shaft, a drive shaft carrying a shaping roller fixed in the axial position thereof is provided in the interior of the hollow shaft, the delivery roller is constructed in the form of a hollow shaft, a drive shaft carrying an upper displaceable shaping roller is provided in the interior of this hollow shaft, the delivery roller and the shaping roller are arranged in slides so as to be displaceable in synchronism, and in addition the two rollers are arranged in a slide likewise displaceable against the axially fixed shaping roller and the displaceable shaping roller. This allows a particularly economic mode of operation.

The shaping roller arranged displaceably and the lower de-livery roller situated thereunder are guided in a particularly precise and stable manner if they are mounted in a slide provided with linear ball bearings.

A very simple possibility of displacement for the further slides, which carry the lower delivery roller likewise displaceable in turn and a lower shaping roller, is achieved by lateral guide plates.

The desired linear displacements of the slides are performed by hydraulic cylinders, which makes a highly compact and advantageous design of the device.

A further advantage consists in the embodiment of a desired synchronous running of the slide, which is made possible by hydraulic components which are likewise available commercially.

The drive shafts of the driven rollers are driven in a highly space-saving manner by way of universal-joint shafts and hydraulic motors and are supplied by a central hydraulic unit and are set and regulated by components known per se to a peripheral synchronism, i.e. to the same peripheral speed of the rollers.

BRIEF DESCRIPTION OF THE SEVERAL VIEWS OF THE DRAWINGS

Embodiments of the invention are explained below with reference to drawings, in which:

FIG. 1 shows a typical connection in ventilation technology; two spiral pipes arranged at a right angle to each other being connected to each other by means of segment curves and folded-seam connections, FIG. 2 shows a folded-seam connection according to FIG. 1 in an enlarged sectional illustration;

FIG. 7 shows the joining of a folded-seam connection;

FIG. 8 shows the form fitting connection of the folded-seam connection of FIG. 7 by folding over the folding tab;

DETAILED DESCRIPTION OF THE INVENTION

Figure 3:
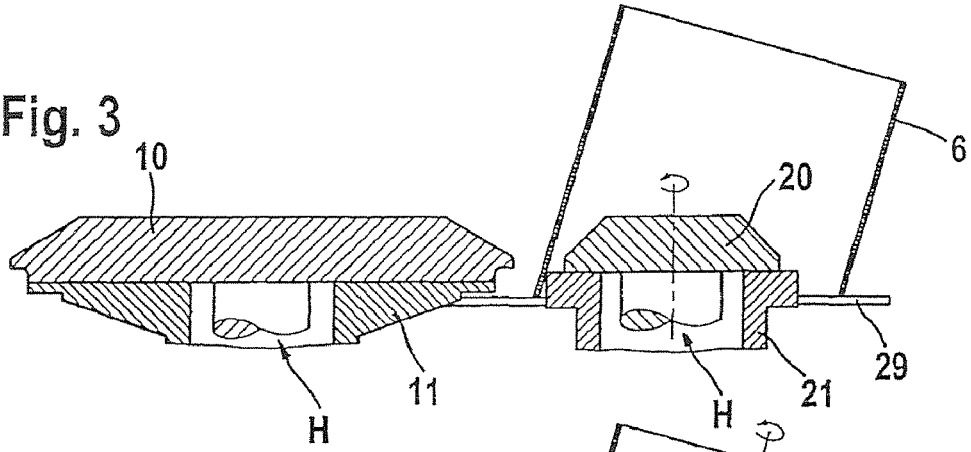
FIGS. 3 to 6 show the individual method steps for producing an internal flange-like double fold according to FIG. 2.

FIG. 1 shows coiled pipes of plated metal sheet S1 and S2 which are generally known as "spiral pipes" and which are connected to each other by way of segment bends s2 to s5. The segment bends s2 to s5 are connected to the pipes S1 and S2 by way of conventional detachable connections V. The connection bends s2 to s5 have beads W which are used as for reinforcement and also as limit stop. The actual folded-seam connections according to the invention are designated A; the median line of the pipe connection is designated m and corresponds to the neutral thread.

The folded-seam connection A is shown in an enlarged sectional illustration in FIG. 2. The middle segment bends s3 and 25 s4 with the first pipe end X and the second pipe end Y are shown here. Offsets 5 in the form of constrictions are provided here. The pipe end X terminates at a flange-like double fold 1, with its flange parts 1*a* and 1*b*, which together form a flange collar. An air gap 3, which acts inter alia as an expansion joint for the segment s3 and at the same time exerts a springing action upon the outer surrounding double fold 2, is formed between the flange parts 1*a* and 1*b*.

The surrounding double fold 2 adjoins the outer region of the flange parts 1*a* and 1*b* and the bend 1*c* on the outside with positive locking. Even if the metal sheet of the double folds displays irregularities, the springing connection illustrated results in contact points which extend more or less concentrically over parts 1*a* to 1*c* and at least act as a labyrinth seal.

The connection of the inner flange, i.e. the double fold 1, to the surrounding double fold 2 is made in a manner known per se or a folding/closing machine, for example of the type Gorelocker Beta 3.

FIGS. 3 to 6 show the production of the flange-like 15 double-fold 1. The molded part or pipe segment to be processed is designated 6 and rests on a support face 29.

In accordance with the method, as shown in FIG. 3, in a first step the pipe end of the segment 6 is turned inside out over a rotating shaping roller 20 and a lower roller 21 which is situated thereunder and which is in the form of a hollow shaft and has a corresponding central lower cavity H which is considerably larger than is necessary for driving the roller 21 without contact. An adjacent shaping roller 10 and a lower delivery roller 11 are in the rest position.

Figure 4:
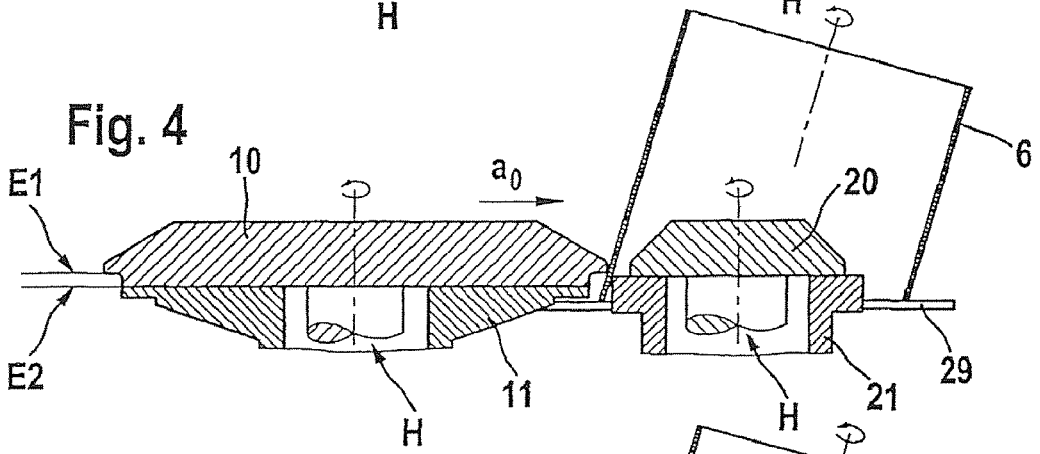
Figure 5:
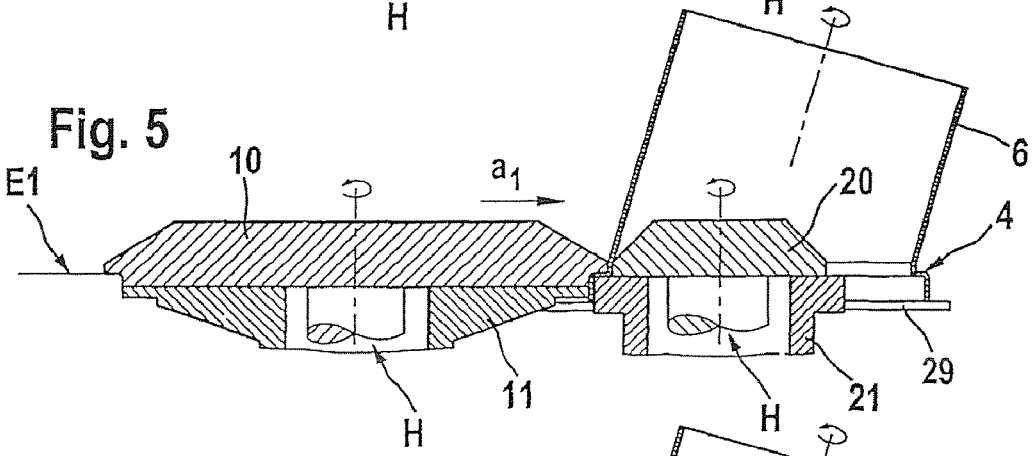

It is clear from FIG. 4 that the two rollers 10 and 11 have been pushed into the molded part 6 by a path ao until it is touched by the shaping roller 10 which in the meantime has likewise been set in rotation. As a result of the friction of the external periphery of the roller 10 on the molded part 6 the latter likewise starts to rotate. Mutually parallel tangential planes E1 and E2, which characterize the possible displacement paths of the rollers 10 and 11, are indicated.

As a result of a stepwise further movement of the rotating shaping roller 11 as far as the end of the path a' a folding tab 4, which extends over the entire periphery of the underside of the molded part 6, is formed on the molded part 6. See FIG. 5.

Figure 6:
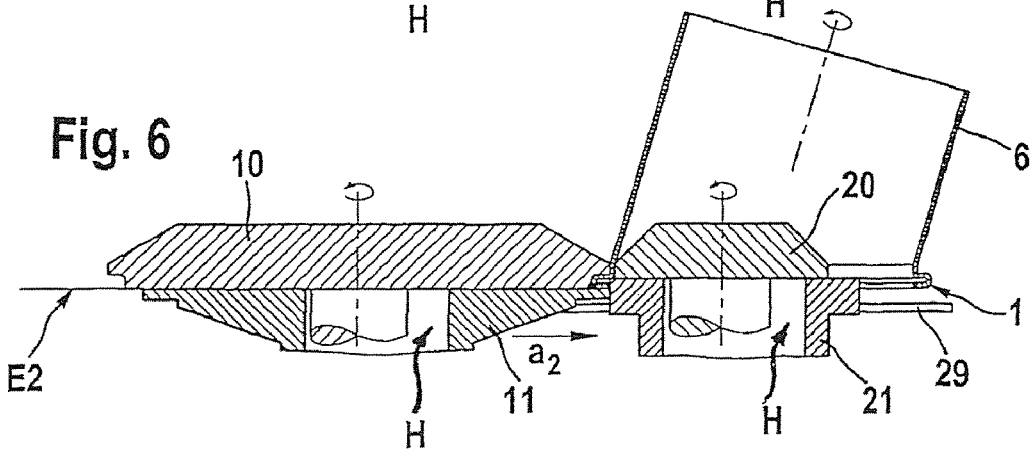

Whilst the molded part 6 continues to rotate, as shown in FIG. 6, the lower delivery roller 11 is likewise advanced by the path a2, but in the plane E2, so that the double fold 1 indicated is formed on the molded part 6. This displacement path is possible since the rollers 11 and 21 have cavities H.

The synchronization of the movement of the two rollers 11 and 21 results in the formation of a fold accurate to shape, without the flange parts being flattened or upset on the rollers.

The molded part 6 with the flange-like double fold at the end thereof can be removed and further processed by returning the rollers to the starting position as shown in FIG. 3.

The assembly of the flange connection may be seen in FIGS. 7 and 8, which are provided with the reference numerals already used. It should be noted that as a result of folding over the folding tab 4 the air gap 3 which is relatively large in FIG. 7 is reduced in FIG. 8 to an air gap 3'. This explains the permanent springing effect observed in practice and thus the sealing inside the folded-seam connection.

Figure 9:
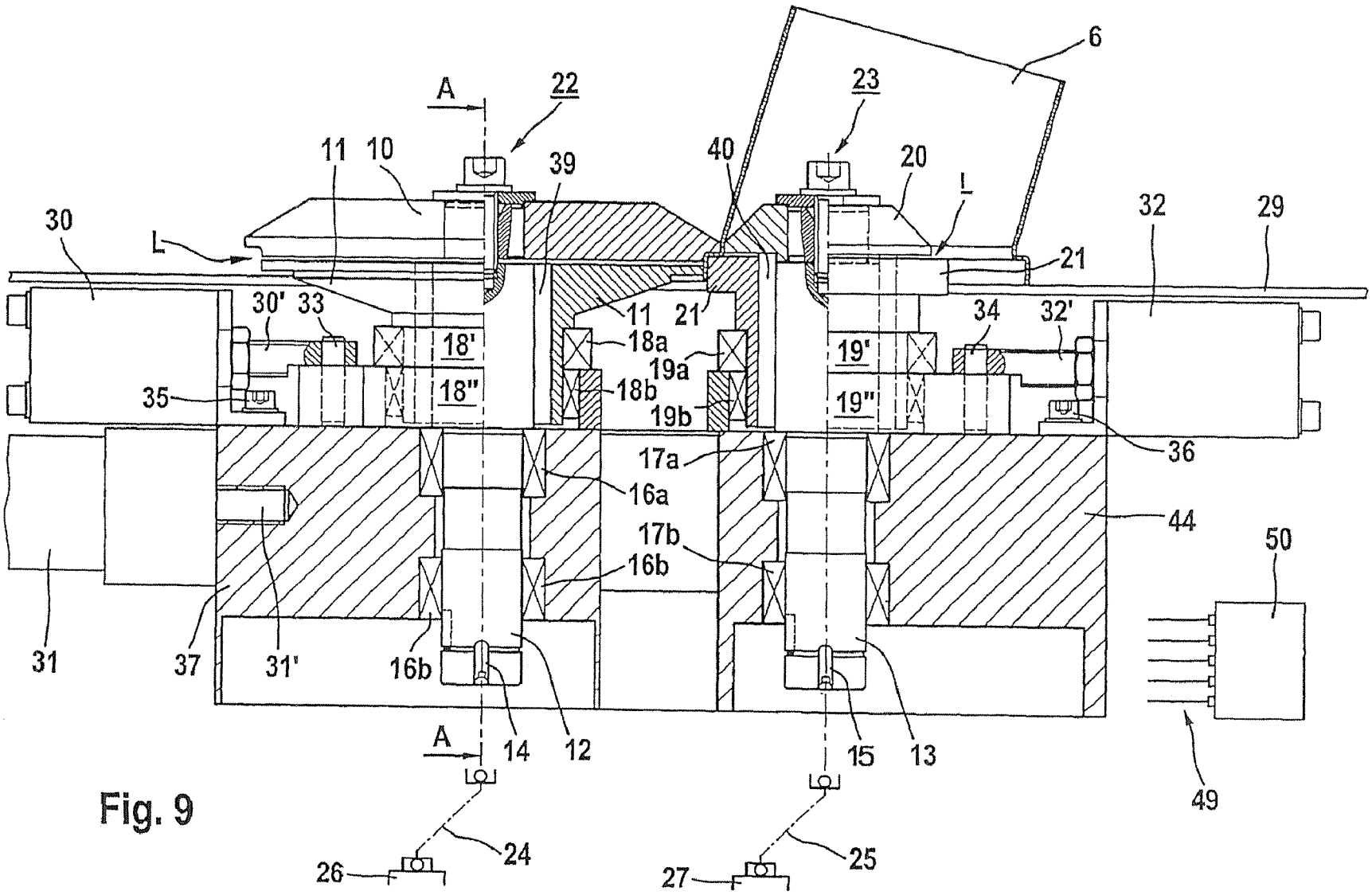
FIG. 9 shows a preferred device or producing a flange-like double fold, in a partial sectional illustration.
Figure 10:
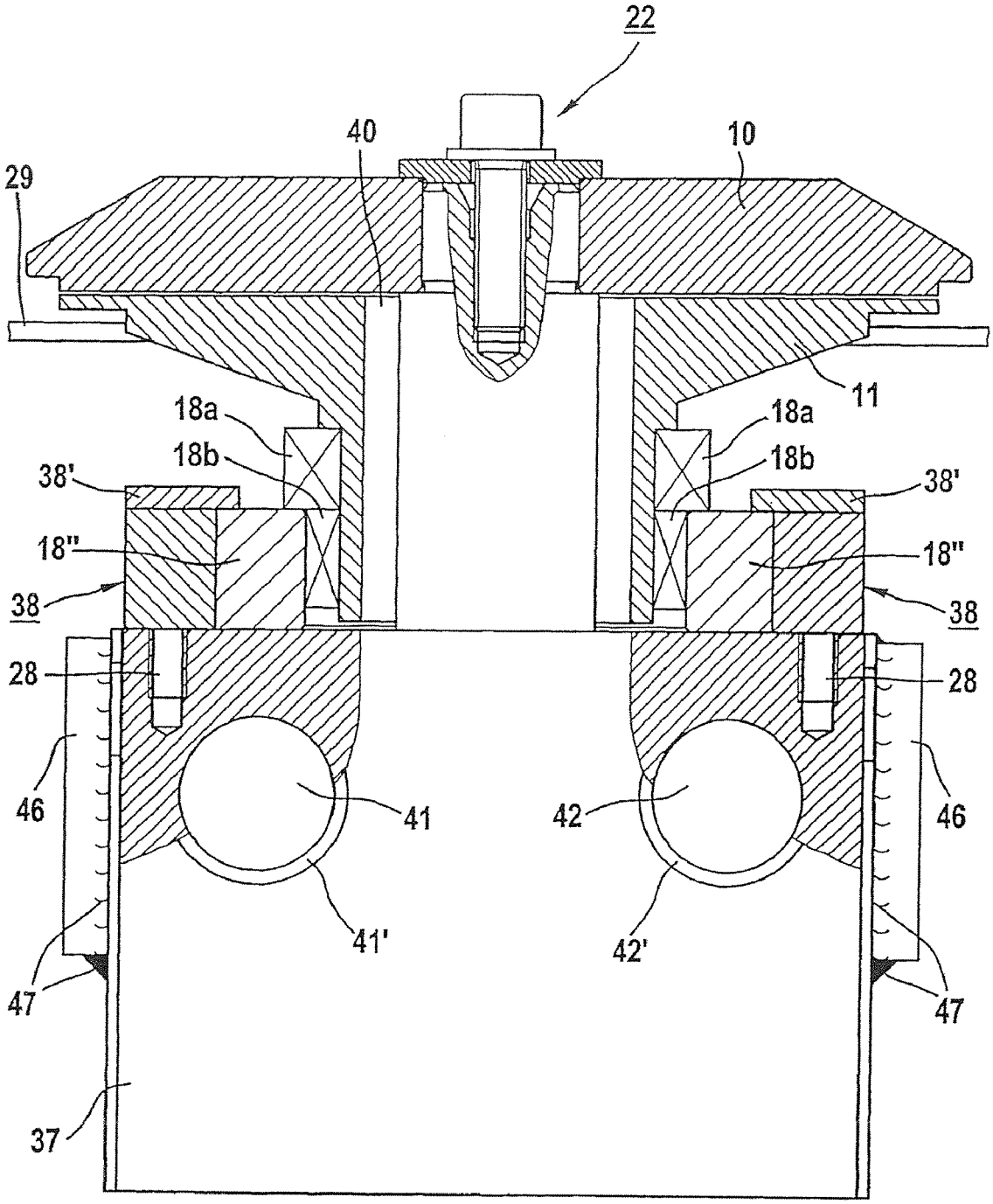
FIG. 10 is a sectional illustration through the drive shaft on the left-hand side, as viewed in a direction at a right angle.
Figure 11:
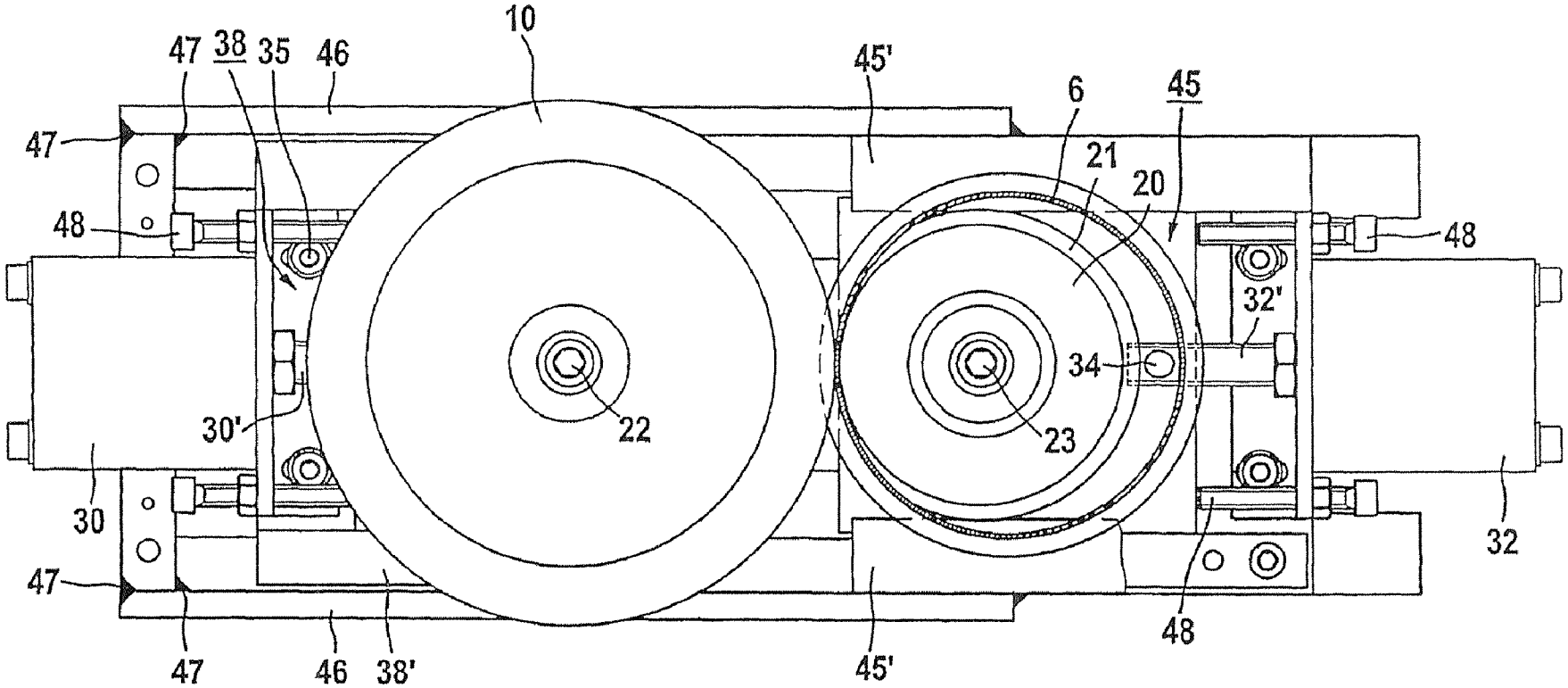
FIG. 11 is a plan view of the device according to FIG. 9 from above.

The method for producing an internal double fold 1 as described with reference to FIGS. 3 to 6, is transformed into a device which is illustrated in FIGS. 9 to 11.

As shown in FIG. 9, the displaceable shaping roller 10 and the delivery roller 11 are mounted in a slide 37 which is likewise displaceable. The roller 10 is fixed on a drive shaft 12 by an axial fastening 22 designed as a screw connection with a wedge. The underside of the drive shaft 12 likewise has a wedge 14 which is coupled to an hydraulic motor 26 by way of a universal joint shaft 24. The shaft 12 is fitted in a slide 7 so as to be rotatably mounted by roller bearings 16*a* and 16*b*, the slide 37 in turn being displaceable by an hydraulic cylinder 31 with a piston rod. A further, slightly smaller hydraulic cylinder 30 is situated thereon, fastened by bolts 35, and engages with its piston rods 30' on a pin 33 which is inserted in a slide 38 likewise displaceable. Further roller 5 bearings 18*a* and 18*b*, which are arranged concentrically to the shaft 12 and which are mounted with their inner rings on the delivery roller 11 designed on the underside as a hollow shaft, are arranged in the slide 38. In addition, a cylindrical cavity 39 is present between the shaft 12 and the bore in the delivery roller 11. The housing of the roller bearings 18*a*, 18*b* is designated 18'; the clearance required for the free rotation of the rollers 10 and 11 is designated L.

The opposite pair of rollers, namely the shaping roller 20 and the lower roller 21 adjacent over the clearance L, are designed in a similar manner. In contrast to the previous one, however, a shaping-roller block 44 is provided which is fixed to the machine, i.e. immovable. The roller 21 is fixed on a drive shaft 13 by an axial fastening 23 designed as a screw connection with a wedge. The drive shaft 13 likewise has a wedge 15 underneath which is coupled to an hydraulic motor 27 by way of a universal joint shaft 25. The shaft 13 is fitted in the block 44 so as to be rotatably mounted by roller bearings 17*a* and 17*b*. An hydraulic cylinder 32 is situated thereon, fastened by bolts 36, and engages with its piston rods 32' on a pin 34 which is inserted in a displaceable slide 45. Roller bearings 19*a* and 19*b*, which are arranged concentrically to the shaft 13 and which are mounted with their inner rings on the displaceable roller 21 designed on the underside as a hollow shaft, are arranged in the slide 45. The housing of the roller bearings 19*a*, 19*b* is designated 19', 19"; the cylindrical air space present is designated 40. The molded part 6 to be processed rests on a support and sliding face on the machine bench 29.

The hydraulic components are fed through a central hydraulic unit 50 which is housed in the machine stand and from which hydraulic lines 49 extend to the control and driving members.

The illustration of the section A-A through the shaft 12 in FIG. 9 is shown in FIG. 10 and shows the components described above and, in addition, two linear ball bearings 41, 42, the bushes 41' and 42' of which are inserted in the slide 37. A fastening frame 46 in the machine stand with its welding 10 seams 47 can be seen at the side.

Threaded bores 28, which are used for fastening lateral plates and guides 38' of the slide 38 screwed thereabove and likewise displaceable, are provided in the displaceable slide. The displaceable part 18" is at the same time the housing of the roller bearings 18*a*, 18*b*. The slide 45 shown in FIG. 9 is designed in a similar manner.

The individual parts may be seen once again in the plan view according to FIG. 11, and likewise the guide plates 45', previously not designated, and in addition adjustment screws 48 which are used for bounding the path and setting the displacement path of the slides 38 and 45.

The mode of operation of the device for the economic production of high-quality and reproducible flange-like double folds is easy to reconstruct with the aid of FIGS. 3 to 6 and the accompanying description. Further details for designs of the device correspond to the machine design according to EP-Al-0 998 997.

Adaptation of the distances between the rollers 10, 11 and 20, 21 takes place in the simplest manner by intermediate 30 rings (not shown) and affects the clearance L accordingly. In this way, the ductility and the springing behavior of the flange-like double fold can be affected and optimized in a simple manner, which also jointly determines the service life of the rollers and the wear on the molded part 6.

In a practical test on folded-seam connections according to the invention, leakage losses have been measured which were at least $20^{9}$.T better than the provisions according to EUROVENT, Class C. The double folds produced and tested had typical fold widths of from 4.0 to 12.0 mm, measured on the internal double fold.

A pre-condition for this, however, is a trouble-free production of the folds, which is possible in a reproducible manner by the device according to the subject of the invention.

These high-quality folded-seam connections are particularly important in processing and clean-room technology etc., in which non-defined leakages can lead to hazards of all types. In this case too, the subject of the invention allows the use of inexpensive pipe segments in connection with well known coiled pipes (spiral pipes) instead of, as generally used, expensive welded pipes with corresponding connections and/or connections sealed off by resilient inlays. In addition, the maintenance required for units of this type is reduced, since metal seals are not subject to wear as a rule.

With respect to further development the device can be automated, in that for example folded-seam connections produced are stored in all their machine settings and control parameters and are then utilized for mass production. For this purpose, "teaching programs" which are already known in principle can be used in conjunction with measurement pick-ups (sensors etc.).

It will further be appreciated by those of ordinary skill in the art that modifications to and variations of the above-30 described folded-seam connection, method of producing it, and device may be made without departing from the inventive concepts disclosed herein. Accordingly, the invention should not be viewed as limited except as by the scope and spirit of the appended claims.

What is claimed is:

1. A method of producing a double fold at a first pipe end, comprising the steps of:

providing first and second motor-driven laterally-displaceable shaping rollers and a lower laterally-displaceable delivery roller associated with each shaping roller, the shaping rollers being in fixed axial positions;

rotating the first shaping roller and putting the first pipe end thereon to establish peripheral contact between the inside of the pipe and the first delivery roller;

rotating the second shaping roller and moving the second shaping roller in a tangential plane until it engages with the exterior of the pipe so that the pipe end jointly rotates in synchronism with the second shaping roller;

pushing the second shaping roller stepwise in the tangential plane towards the first shaping roller a distance of the width of the double fold against the first shaping roller so that a continuous folding tab oriented outwardly to the pipe is formed at the pipe end between the second shaping roller and an upper surface of the first delivery roller;

pushing the second delivery roller in a direction towards the first shaping roller in a second plane situated at a lower level than the tangential plane by at least twice the thickness of the pipe material, whereby the first delivery roller is laterally drawn back under the influence of the second shaping roller in synchronism in the opposite direction whereby a distal portion of the folding tab is folded back towards the pipe such that the folding tab is formed into a double fold flange.

2. The method of claim 1, wherein the shaping rollers are each driven by a shaft extending through a hollow center of the associated delivery roller.

3. A method of producing metallic sealing folded-seam connections, at least partly positively locking, on ductile pipes and/or pipe-bend segments on a flanging and/or folding/closing machine having two rotatably mounted shaping rollers and delivery rollers displaceable in one plane, wherein the two shaping rollers are driven by a motor and project from a machine bench such that a double fold flange is produced at a first pipe end, comprising:

rotating a first shaping roller and putting a first pipe end thereon to establish contact between an inside of the first pipe and a first delivery roller;

rotating a second shaping roller and moving the second shaping roller laterally until it engages with the exterior of the first pipe so that the first pipe end jointly rotates in synchronism with the second shaping roller;

pushing the second shaping roller laterally towards the first shaping roller a distance of the width of the double fold against the first shaping roller so that a continuous first folding tab oriented outwardly to the first pipe is formed at the first pipe end between the second shaping roller and an upper surface of the first delivery roller;

pushing a second delivery roller laterally towards the first shaping roller by at least twice the thickness of the first pipe material, whereby the first delivery roller is laterally drawn back under the influence of the second shaping roller in synchronism whereby a distal portion of the first folding tab is folded back towards the first pipe such that the folding tab is formed into a double fold flange;

forming a second folding tab with an internal spacing between flange parts larger than a thickness of the double fold flange on the other pipe end to be joined;

pushing the second folding tab over the double fold flange; and pressing and clamping the second folding tab against the double fold flange in an abutting manner, whereby the double fold flange is surrounded by the second folding tab in a sealed manner.

4. The method of claim 3, wherein the shaping rollers are each driven by a shaft extending through a hollow center of the associated delivery roller.

* * * * *